US005560074A

United States Patent [19]

Graham et al.

[11] Patent Number: 5,560,074

[45] Date of Patent: Oct. 1, 1996

[54] CONVERTIBLE VACUUM CLEANER

[75] Inventors: Scott R. Graham, Zeeland; Eric R. Metzger, Sand Lake; John J. Jailor, Rockford; Gary L. Smith, Belding, all of Mich.

[73] Assignee: Bissell Inc., Grand Rapids, Mich.

[21] Appl. No.: 511,715

[22] Filed: Aug. 4, 1995

[51] Int. Cl.[6] ..... A47L 5/32

[52] U.S. Cl. ..... 15/323; 15/331; 15/334

[58] Field of Search ..... 15/331, 332, 333, 15/334, 337, 323

[56] References Cited

U.S. PATENT DOCUMENTS

| | | | |
|---|---|---|---|
| Re. 32,257 | 10/1986 | Dyson . | |
| 1,217,817 | 2/1917 | Peters . | |
| 1,953,944 | 4/1934 | Becker . | |
| 2,070,689 | 2/1937 | Smellie . | |
| 2,175,642 | 10/1939 | Replogle | 15/334 |
| 2,686,331 | 8/1954 | Humphrey . | |
| 2,747,215 | 5/1956 | Segesman | 15/333 |
| 2,876,481 | 3/1959 | Gerber et al. . | |
| 2,898,621 | 8/1959 | Vance . | |
| 2,898,622 | 8/1959 | Hurd . | |
| 3,588,945 | 6/1971 | Krier et al. . | |
| 3,869,751 | 3/1975 | Boyd et al. . | |
| 3,879,797 | 4/1975 | Principe et al. . | |
| 3,942,219 | 3/1976 | Johnson . | |
| 4,225,999 | 10/1980 | Martinec et al. . | |
| 4,376,322 | 3/1983 | Lockhart et al. . | |
| 4,563,790 | 1/1986 | Clark . | |
| 4,571,772 | 2/1986 | Dyson . | |
| 4,573,236 | 3/1986 | Dyson . | |
| 4,660,246 | 4/1987 | Duncan et al. . | |
| 4,686,736 | 8/1987 | Petralia et al. . | |
| 4,811,452 | 3/1989 | Sumerau . | |
| 4,955,106 | 9/1990 | Stein et al. . | |
| 5,134,750 | 8/1992 | King et al. . | |
| 5,222,276 | 6/1993 | Glenn, III . | |
| 5,243,734 | 9/1993 | Maurer et al. . | |
| 5,247,720 | 9/1993 | Sovis et al. . | |
| 5,309,601 | 5/1994 | Hampton et al. . | |
| 5,331,715 | 7/1994 | Johnson et al. . | |
| 5,345,650 | 9/1994 | Downham et al. . | |
| 5,351,361 | 10/1994 | Buchtel . | |
| 5,355,586 | 10/1994 | Steinberg et al. | 15/334 |
| 5,477,586 | 12/1995 | Jacobs et al. | 15/332 |

*Primary Examiner*—Chris K. Moore

*Attorney, Agent, or Firm*—Varnum, Riddering, Schmidt & Howlett LLP

[57] ABSTRACT

A convertible vacuum cleaner operable in both on-the-floor and above-the-floor cleaning operations is shown. Depending upon the location of the handle which is pivotally supported by the vacuum foot, a conversion valve interconnected to the handle automatically converts the vacuum between on-the-floor and above-the-floor cleaning operations. The conversion valve includes a flapper valve member which is actuated between a first position blocking fluid communication between the vacuum motor and the brush roll chamber and a second position blocking fluid communication between the vacuum motor and the accessory hose. The valve member is actuated between these two positions by a pin and actuator arm provided on the pivotally mounted valve member. The pin is received in a contoured groove formed on the motor housing and the motor housing is securely mounted to the handle and pivotally mounted with respect to the foot and valve member. As the handle is tilted between the substantially upright position and a tilted position, the flapper valve member is actuated between the first and second positions.

20 Claims, 4 Drawing Sheets

CONVERTIBLE VACUUM CLEANER

BACKGROUND OF THE INVENTION

1. Field of the Invention

This invention relates to vacuum cleaners and, more particularly to a vacuum cleaner which is convertible from on-the-floor cleaning to above-the-floor cleaning. In another aspect, the invention relates to a conversion valve for converting an upright vacuum cleaner from on-the-floor to above-the-floor cleaning.

2. Description of the Related Art

Upright vacuum cleaners which are convertible from on-the-floor cleaning to above-the-floor cleaning are known in the prior art. Upright vacuum cleaners for on-the-floor cleaning typically have a brush roll housed in a chamber which is in fluid communication with the vacuum motor and open to the bottom surface of the foot. A wand or flexible hose on the foot or upright housing of an upright vacuum cleaner is fluidly connected to the vacuum motor to perform above-the-floor cleaning. A valve is typically used to control the source of suction generated by the vacuum motor between one of two suction openings, i.e., the brush roll chamber of the foot and the flexible hose. Examples of known upright vacuum cleaners of this type are disclosed in U.S. Pat. No. 5,351,361 to Buchtel; U.S. Pat. No. 5,222,276 to Glenn III; U.S. Pat. No. 4,376,322 to Lockhart et al; and U.S. Pat. No. 2,070,689 to Smellie. Another example of a vacuum cleaner having a valve for controlling air flow is U.S. Pat. No. 5,345,650 to Downham et al.

One problem with the prior art conversion valves for convertible upright vacuum cleaners is the automatic actuation of the conversion valve between on-the-floor cleaning and above-the-floor cleaning and vice-versa in response to the position of the upright handle between an upright position and a rearwardly tilted operating position. Several of the known conversion valves will automatically actuate a valve from the above-the-floor cleaning position to the on-the-floor cleaning position. However, most conversion valve systems of the prior art do not automatically actuate the valve to convert from on-the-floor cleaning to above-the-floor cleaning when the handle is returned to the upright position.

A second problem encountered in the conversion valve systems of the prior art is effectively sealing the air flow passageway to the closed suction opening so that essentially all of the air flow generated by the vacuum motor is directed to only the selected suction opening, i.e., the brush roll chamber or the flexible hose. An ineffective seal within the conversion valve will result in a reduction of the performance efficiency of the vacuum motor in generating lift in the selected suction opening.

SUMMARY OF THE INVENTION

The convertible upright vacuum cleaner having a conversion valve according to the invention overcomes the problems of the prior art by automatically converting the vacuum cleaner between on-the-floor cleaning and above-the-floor cleaning and vice versa, depending upon the position of the upright handle relative to the foot. Secondly, the conversion valve according to the invention creates an effective seal in the air flow passageway, between the vacuum motor and brush roll chamber and hose thereby minimizing the loss of suction power or lift generated by the vacuum motor at the selected suction opening, either the flexible hose or brush roll chamber.

In one aspect, the invention relates to a convertible vacuum cleaner comprising a foot having a working air flow path and first and second suction openings, both in fluid communication with the working air flow path. A source of suction is also in fluid communication with the working air flow path. A handle is pivotally mounted to the foot for movement between a substantially upright position and a titled position. A contoured cam is provided on the handle. The cam has a first contoured portion and a second contoured portion. A conversion valve member is pivotally provided on the foot between the source of suction and the first and second suction openings. The conversion valve member selectively blocks fluid communication between the first and second suction openings and the source of suction. The conversion valve member comprises a rotation shaft mounted to the foot for rotation about an axis of rotation and a flapper valve element nonrotatably mounted to the rotation shaft. The flapper valve element is positioned in the working air flow path and pivotal about the rotation shaft axis of rotation between a first position and a second position. In the first position, the flapper valve element blocks fluid communication between the source of suction and the first suction opening. In the second position, the flapper valve element blocks fluid communication between the source of suction and the second suction opening. A cam follower is coupled to the rotation shaft and positioned to abut the contoured cam. The cam follower is adapted to follow the cam as the handle rotates relative to the foot. The cam is shaped so that the flapper valve element is in the first position when the handle is in the substantially upright position and is in the second position when the handle is in the tilted position.

In one embodiment, the contoured cam comprises a groove having first and second contoured portions wherein the cam follower is slidably received in the groove. Preferably, the cam follower comprises a pin.

In another embodiment, the handle comprises a housing supporting the source of suction. Preferably, the groove is provided on the housing such that the handle rotates relative to the base as the flapper valve element is actuated between the first and second positions.

In another embodiment, the first contoured portion is substantially linear and the second contoured portion is arcuate.

In still another embodiment, the working air flow path comprises a bottom wall, a pair of side walls and a shoulder formed between the bottom and side walls. The flapper valve element is adapted to abut the shoulder in the first position thereby created an effective seal between the source of suction and the second suction opening.

In another aspect, the convertible vacuum cleaner according to the invention comprises a source of suction, a foot having a first suction opening in fluid communication with the source of suction and a handle having an upper end and a lower end wherein the lower end is pivotally supported on the foot. A flexible hose is provided and is adapted for above-the-floor cleaning. The hose is in fluid communication with the source of suction and has a collar provided on an upper end thereof. The collar is open on its outer end. A conversion valve is provided for selectively controlling the air flow between the source of suction and the first suction opening and flexible hose. A housing is provided adjacent the upper end of the handle wherein the housing has a top wall, at least one side wall and an open bottom. A retainer is provided on one of the handles in the housing for selectively retaining the collar of the hose to one of the handle and the housing. The retainer and collar are provided so that when the collar is properly received in the retainer, the open outer end of the collar is spaced from the walls of the housing and remains unobstructed for the free flow of air therethrough.

In another embodiment, the hose is extendable between a retracted position and an extended position. Preferably, the hose is in the retracted position when the collar is properly received in the retainer.

BRIEF DESCRIPTION OF THE DRAWINGS

The invention will now be described with reference to the drawings in which:

FIG. 6 is a sectional view of the conversion valve assembly taken along lines 6—6 of FIG. 3; and.

DETAILED DESCRIPTION OF THE PREFERRED EMBODIMENTS

Figure 1:
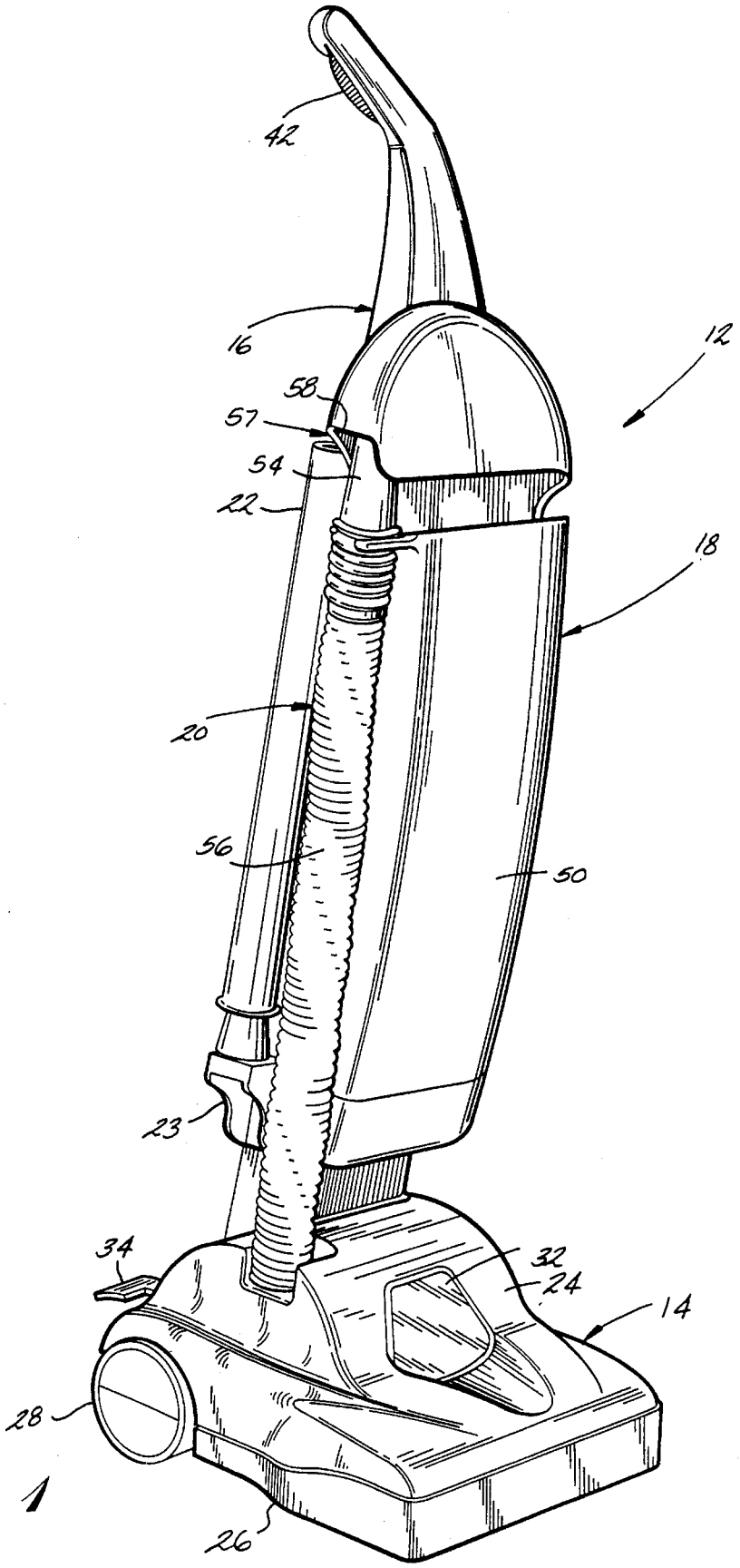
FIG. 1 is a perspective view of a convertible upright vacuum cleaner according to the invention.

Referring now to the drawings and to FIG. 1 in particular, a convertible upright vacuum cleaner 12 according to the invention is shown. The vacuum cleaner 12 comprises a floor engaging foot 14, a handle 16 pivotally mounted to and extending upwardly from the foot, a bag housing 18 provided on the handle 16 and a flexible hose 20 extending upwardly from the foot 14. A rigid accessory wand 22 is provided on a support member 23 formed on the bag housing 18. The wand 22 can be removed from the support member 23 and connected to the flexible hose 20 for above-the-floor cleaning operations. Alternatively, the foot 14 can be pushed along the floor for traditional on-the-floor cleaning.

The foot 14 comprises a cover 24 which is selectively mounted to a base pan 26 (FIG. 2), a pair of rear wheels 28 provided on the base pan for rollably supporting the rear of the vacuum cleaner 12 and a pair of conventional front wheels (not shown) for rollably supporting the front of the foot 14. A conventional pair of lift wheels 30 (FIG. 3) are provided intermediate the front and rear wheels and are adapted to lift the front of the foot 14 away from the floor when the handle 16 is in the upright position to prevent the rotating brush roll 68 (FIG. 3) from damaging the carpet. A conventional light (not shown) and lens 32 are provided on the front of the cover 24 for illuminating the area in front of the foot. A conventional foot switch 34 extends outwardly from the rear of the foot 14 and is adapted to open and close the electrical circuit between a conventional source of electricity and the vacuum motor.

The handle 16 comprises an elongated shaft 40 having a hand grip 42 provided on an upper end thereof and a motor housing 70 provided at the lower end. As described further below, the handle 16 is pivotally mounted to the foot 14.

The bag housing 18 is provided on the handle 16 and is adapted to support a conventional filter bag which receives the dirt and debris picked up by the vacuum motor. An access panel 50 is provided on the front of the bag housing 18. The panel 50 can be removed or pivotally opened relative to the bag housing 18 to provide access to the hollow interior thereof for changing the filter bag.

The flexible hose 20 comprises an extendible body portion 56 having a rigid collar 54 mounted on one end, the other end being securely mounted to the foot 14. Preferably, the extendible body 56 is biased into a retracted position, as seen in FIG. 1. However, the hose 20 can be easily extended a sufficient distance by simply pulling the collar 54 away from the foot 14. Preferably, the hose is extendible to approximately five times the retracted length. An example of a suitable hose is a 5 to 1 extendible hose manufactured by Flexible Technologies, Inc., of Abbeville, S.C. While the incorporation of an extendible hose 20 is preferred, any flexible hose or rigid wand is suitable for use with the invention.

Figure 7:
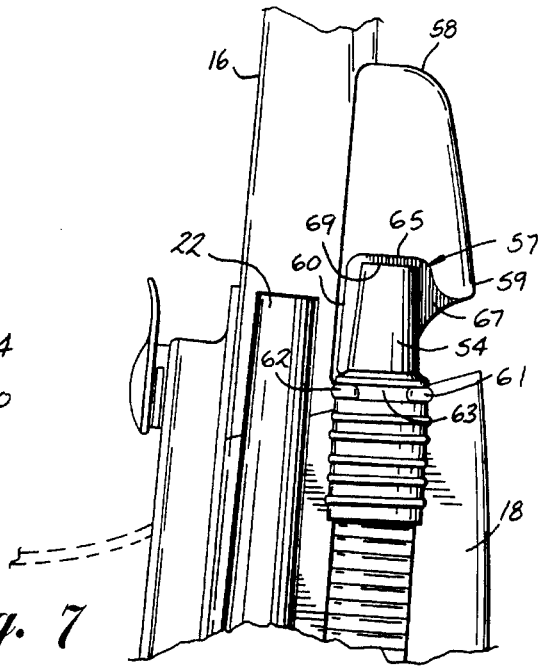
FIG. 7 is a side elevational view of the flexible hose handle and mounting therefor.

Referring now to FIGS. 1 and 7, the collar 54 is received in a recess 57 formed in a housing 58 provided at the top of the bag housing 18. The recess 57 is defined by a front wall 59, a rear wall 60, a top wall 65 and an interior side wall 67. The bottom and exterior side of the recess 57 are open for receiving the collar 54.

The collar 54 is secured to the bag housing 18 by a pair of opposed flexible support arms 61, 62 provided on the bag housing 18. The flexible support arms 61, 62 are selectively received in a groove 63 formed on the collar 54. The arms 61, 62 and groove 63 are positioned such that the open end 69 of the collar 54 is spaced from each of the walls defining the recess 57 or housing 58. With this structure, the open end 69 of the collar 54 is unobstructed so that air can be drawn into the hose 20 when the handle 16 is in the substantially upright position.

Figure 2:
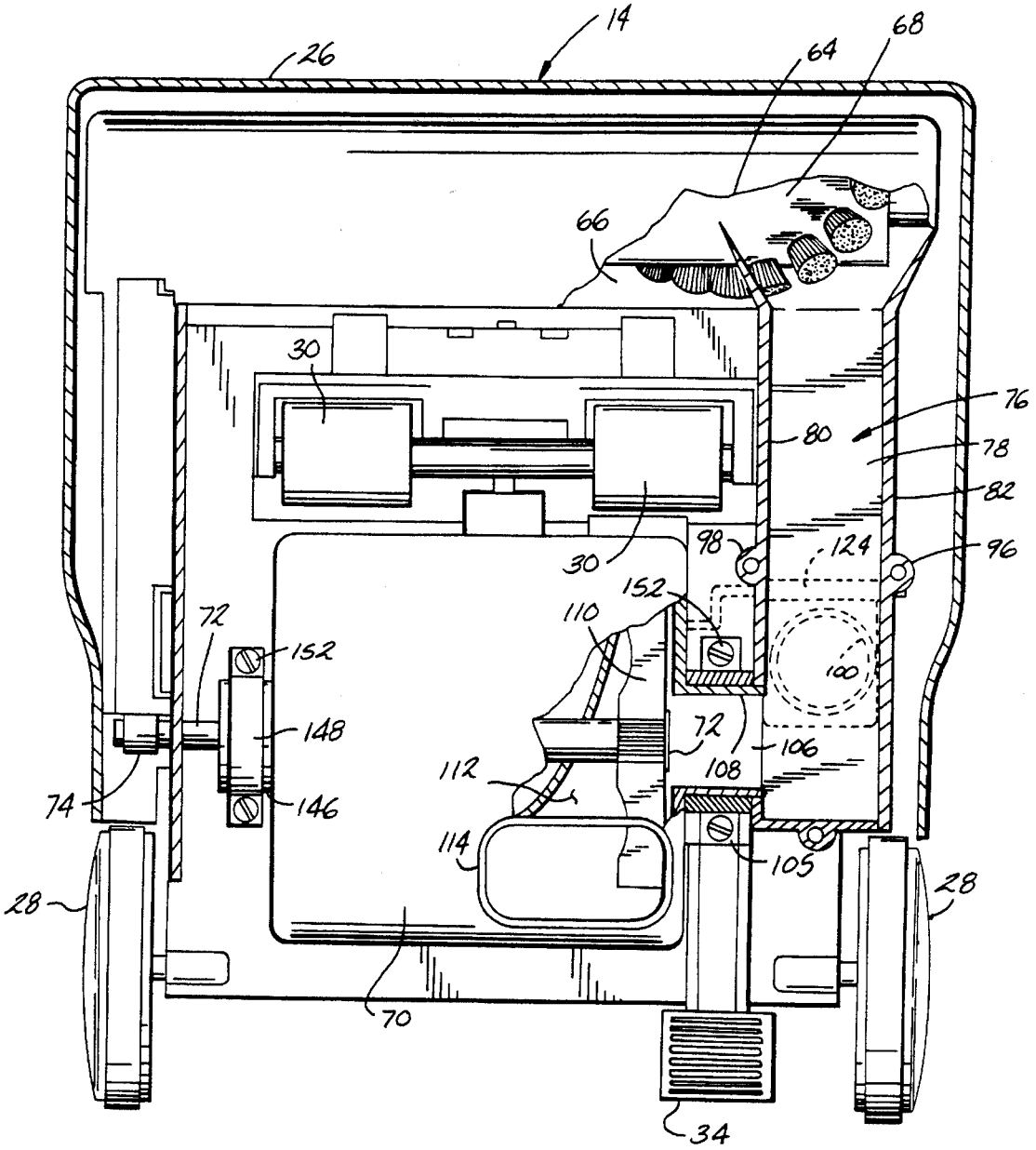
FIG. 2 is a top view of the foot of the convertible upright vacuum cleaner with the cover removed therefrom showing the interior of the foot.

Referring now to FIG. 2, a vacuum motor (not shown) is provided inside the vacuum motor housing 70 of the handle 18 which is rotatably mounted to the base pan 26. A circular boss 108 extends from one end of the vacuum motor housing 70 and a second circular boss 146 extends from the other end of the vacuum motor housing. The bosses 108, 146 are received in a pair of semicircular rotation recesses (not shown) integrally formed in the base pan 26 and a pair of conventional semi-circular retention brackets 148, 150 complement the rotation recesses to encircle the bosses 108, 146. Conventional fasteners 152 are used to secure the retention brackets 148, 150 to the base pan 26. The rotation recesses, circular bosses 108, 146 and retention brackets 148, 150 cooperate to pivotally secure the handle 18 to the base pan 26.

The motor shaft 72 of the vacuum motor extends from one end of the housing 70 and receives a brush roll belt 74. The belt 74 extends forwardly to capture one end of the brush roll 68 such that the force of rotation from the motor shaft 72 is transferred to the brush roll 68. Preferably, the vacuum motor housing 70 and base pan 26 are designed such that the vacuum motor housing rotates about the axis of rotation of the shaft 72 and the bosses 108, 146 are concentrically aligned with the axis of the shaft 74.

An impeller fan 110 is mounted on the other end of the motor shaft 72 immediately adjacent the boss 108. The impeller fan 110 is received in a conventional volute chamber 112 of the vacuum motor housing 70. The volute chamber 112 terminates in an outlet conduit 114 which is integrally formed with the vacuum motor housing 70 and extends outwardly therefrom. The outlet conduit 114 is received inside the handle 16 and is securely mounted thereto by conventional fasteners (not shown). The handle 16 has extending therethrough a conduit (not shown) which extends from the outlet conduit 114 to the vacuum bag (not shown) secured inside the bag housing 18. The handle 18 rotates with respect to the base pan 26 about the axis of rotation of the motor shaft 72.

Figure 4:
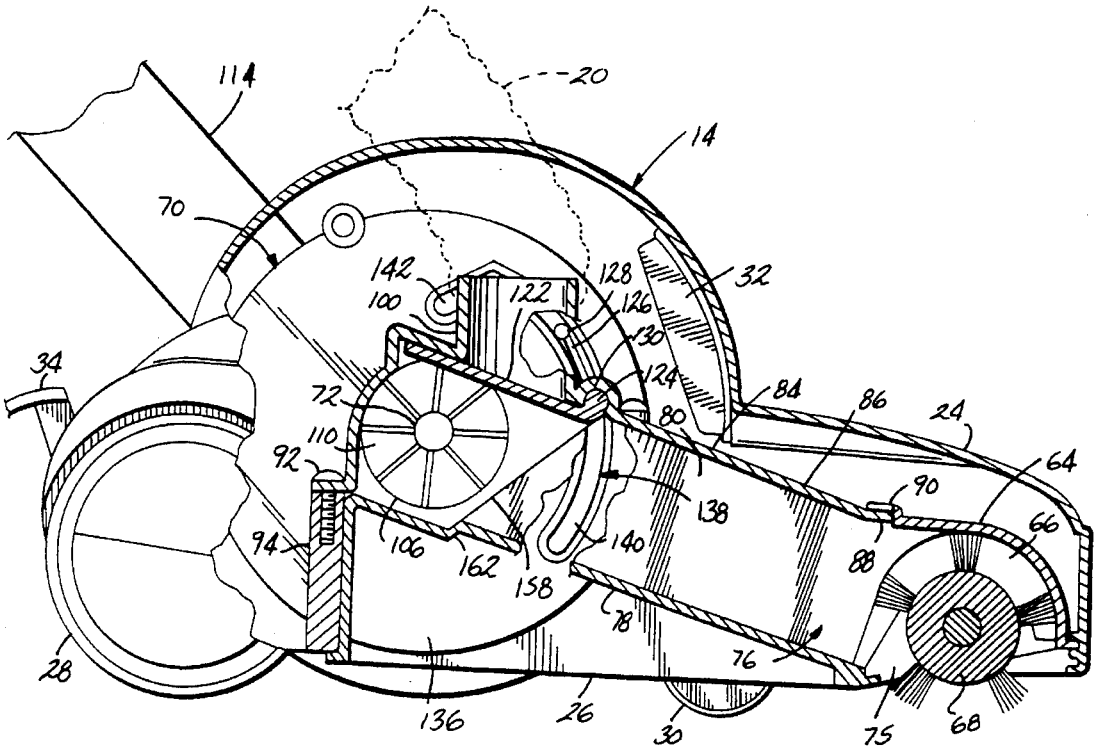
FIG. 4 is a sectional view of the foot similar to FIG. 3 showing the handle in a rearwardly titled position.
Figure 3:
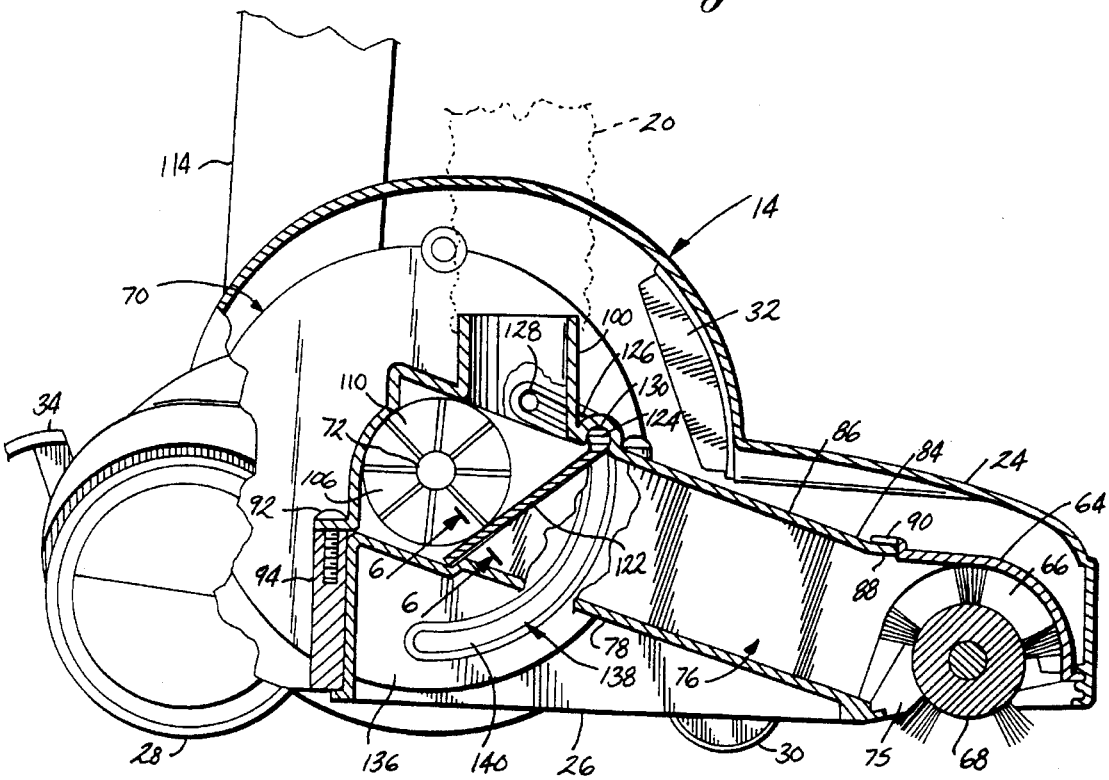
FIG. 3 is a sectional view of the foot taken along lines 3—3 of FIG. 1 with the handle in the substantially upright position.
Figure 5:
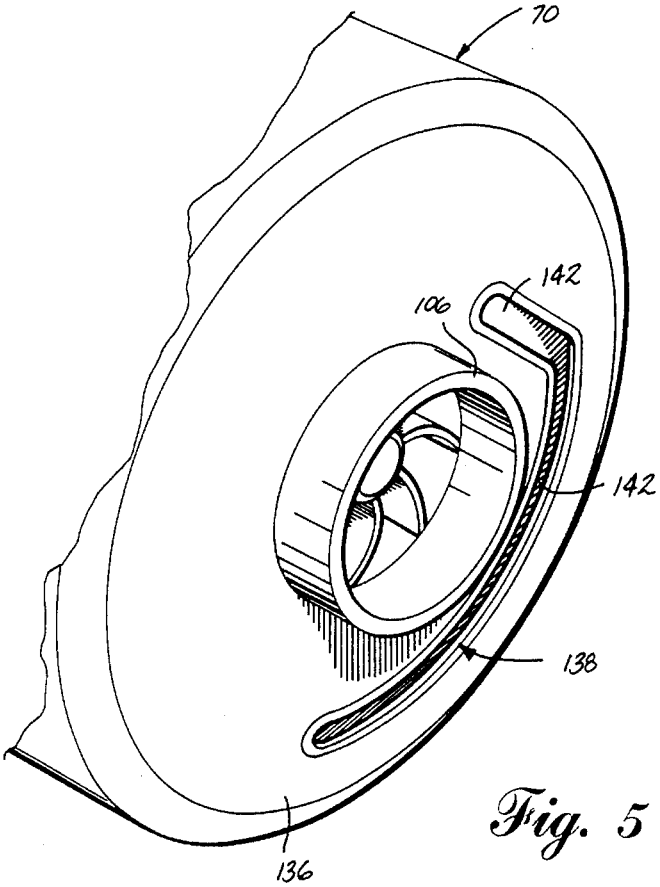
FIG. 5 is a partial, exploded view of the conversion valve assembly according to the invention.
Figure 5:
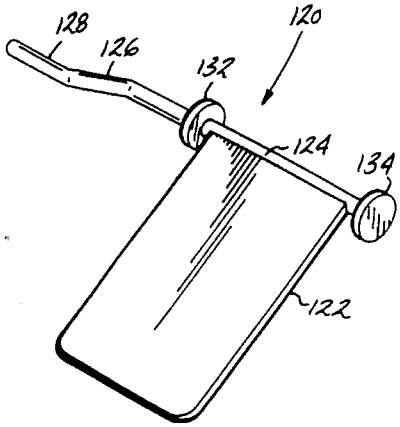

As shown in FIGS. 2–4, an intermediate wall 64 of the base pan 26 forms a brush roll chamber 66 in which a conventional brush roll 68 is rotatably mounted. A downwardly directed brush roll opening 75 is provided in the brush roll chamber 66 for conventional on-the-floor cleaning. A working air conduit 76 extends rearwardly from one end of the brush roll chamber 66 and the conduit 76 is defined by a bottom wall 78, a pair of opposed side walls 80, 82 and a top wall 84. The bottom wall 78 and side walls 80, 82 are preferably integrally molded with the base pan 26. The top wall 84 is formed by a top plate 86 which extends rearwardly from the brush roll chamber 66. The top plate 86 has a tab 88 formed along the front edge, the tab 88 being received in a U-shaped recess 90 formed in the intermediate wall 64. The rear of the top plate 86 is secured by a conventional fastener 92 to a support 94 which is integrally molded to and extends upwardly from the base pan 26. The top plate 86 is secured to the base pan 26 intermediate the rear support 94 and the front tab 88 by conventional fasteners (not shown) which extend through the top plate 86 and are received in supports 96, 98 that are integrally formed with the side walls 80, 82. A flexible hose mount 100 is integrally formed in the top plate 86 and the lower end of the flexible hose 20 is preferably threadably mounted on the flexible hose mount 100. However, other conventional means such as adhesives can be used to secure the lower end of the hose to the mount 100.

The working air conduit 76 terminates at a point immediately adjacent the flexible hose mount 100 and has an aperture 106 formed in the side wall 80 adjacent this end of the conduit 76. With this structure, an air flow path is defined between the flexible hose 20 and the aperture 106. An air flow path is also defined between the brush roll chamber 66 and the aperture 106. The hollow boss 108 of the vacuum motor housing 70 abuts the side wall 80 at the aperture 106. The boss 108 and aperture 106 cooperate to establish fluid communication between the working air conduit 76 and the impeller fan 110. Suction is created in the aperture 106 by rotation of the impeller fan 110.

As shown in FIGS. 2–6, the convertible upright vacuum cleaner 12 according to the invention incorporates a conversion valve assembly 120 to selectively direct the suction generated by the impeller fan between the brush roll chamber 68 and the flexible hose 20 depending upon the position of the handle 16 relative to the foot 14. The conversion valve assembly 120 comprises a flapper valve member 122 which is provided on a rotation shaft 124. A crank arm 126 extends laterally from one end of the rotation shaft 124 and a pin 128 extends outwardly from the end of the crank arm 126. A pair of retention stops 132, 134 are provided on the rotation shaft adjacent the sides of the flapper valve member 122. Preferably, the axis of the pin 128 is perpendicular to the axis of the crank arm 126 and parallel to the axis of the rotation shaft 124.

The flapper valve member 122 is pivotally mounted to the sidewalls 80, 82 for rotation about the axis of rotation shaft 124. The flapper valve member 122 is positioned in the working air conduit 76 and is adapted to selectively seal one of the two suction openings, i.e., the flexible hose 20 or brush roll chamber 66, from the impeller fan 110 and volute chamber 112. The top plate 86 has formed therein an arcuate rotation shaft recess 130 which rotatably receives the rotation shaft 124. The ends of the shaft 124 extend beyond the sides of the top plate 86 and are supported on the top edges of the side walls 80, 82 such that the retention stops 132, 134 are located outside of the working air conduit 76 and adjacent the side walls 80, 82. The rotation shaft recess 130 of the top plate 86 and the upper edges of the side walls 80, 82 cooperate to pivotally mount the rotation shaft 124 with the retention stops 132, 134 limiting the lateral movement of the flapper valve member 122 inside the conduit 76. The rotation shaft 124 is received in the recess 130 such that the crank arm 126 and pin 128 extend inwardly from the side wall 80.

The side wall 136 of the vacuum motor housing 70 has integrally formed therein a contoured groove 138 which comprises an arcuate portion 140 and a linear portion 142. The arcuate portion 140 extends across an arc of approximately 90° and the linear portion 140 extends from the upper end of the arcuate portion 140. The groove 138 is adapted to slidably receive the pin 128 of the crank arm 126. The width of the groove 138 is slightly greater than the diameter of the pin 128 such that the pin slides along the groove 138 without excess lateral movement of the pin 128 within the groove 138. Preferably, at least one of the pin 128 and vacuum housing side wall 136 are formed from a low-friction thermoplastic material such that no additional lubrication is necessary for the efficient sliding motion of the pin 128 along the length of the groove 138. An example of a suitable material is DELRIN II™, an acetal based resin available from DuPont Co., Wilmington, Del.

The position of the flapper valve member 122 of the conversion valve assembly 120 is dependent upon the rotational position of the handle 16 and vacuum motor housing 70 relative to the base pan 26. With the handle 16 received in the upright position as seen in FIG. 3, the pin 128 of the conversion valve assembly 120 is positioned at the terminal end of the linear portion 142 of the groove 138. Preferably, the handle 16 in this position is actually tilted overcenter, slightly forward of the vertically upright position and the crank arm 126 is slightly plastically deformed such that the arm 126 acts as a spring, biasing the flapper valve member 122 into one of the two positions. With the pin 128 in this position of the groove 138, the flapper valve member 122 is pivoted downwardly to establish fluid flow communication between the flexible hose 20 and the volute chamber 112 and block fluid flow communication between the brush roll chamber 66 and the volute chamber 112. Therefore, all of the suction generated by the rotation of the impeller fan 110 is directed solely to the flexible hose 20 for above-the-floor cleaning.

The vacuum cleaner 12 is easily converted from above-the-floor cleaning to on-the-floor cleaning by merely tipping the handle 16 rearwardly into the operative position as seen in FIG. 4. As the user initially rotates the handle 16 rearwardly from the over-center position as seen in FIG. 3, the pin 128 slides along the length of the linear portion 142 of the groove 138. When the pin 128 reaches the junction of the arcuate portion 140 and linear portion 142, continued rotation of the handle 16 causes the pin 128 to enter the arcuate portion and follow the arc of rotation of the arcuate portion 140. The crank arm 126 and flapper valve 122 are pivoted about the rotation shaft 124 from the first position as seen in FIG. 3 into the second position as seen in FIG. 4 as the pin 128 is forced from the linear portion 142 to the arcuate portion 140. In the second position, the flapper valve member 122 establishes fluid flow communication between the volute chamber 112 and the brush roll chamber 66 and blocks fluid flow communication between the flexible hose 20 and volute chamber 112. Therefore, all of the suction or lift generated by the impeller fan 110 is directed solely to the brush roll chamber 66.

The center point of the arc of the arcuate portion 140 of the groove 130 is the axis of rotation of the vacuum motor housing 70 which is also the axis of rotation of the handle 16 with respect to the foot 14. Therefore, as the user alters the angular position of the handle 16 relative to the foot 26 during on-the-floor cleaning, the flapper valve member 122 remains in the second position depicted in FIG. 4. The length of the arcuate portion 140 of the groove 138 is dimensioned to correspond to the entire range of motion for the handle from the vertically upright position to a substantially horizontal position.

As the user returns the handle 16 from the rearwardly tilted operative position as shown in FIG. 4 to the vertically upright position, the pin 128 approaches the junction of the arcuate and linear portions 140, 142 of the groove 138. The pin 128 is positioned at the junction of the arcuate and linear portions when the handle 16 is substantially vertical. Continued rotation of the handle 16 to the over-center position forces the pin 128 into the linear position of the groove 138. As the pin 128 is forced into the linear portion 142, the pin 128 crank arm 126 and flapper valve member 122 rotate about the axis of rotation of the rotation shaft 124 to assume the first position as shown in FIG. 3. As is evident from above, the conversion valve assembly according to the invention automatically converts the vacuum cleaner 12 between above-the-floor cleaning operation and on-the-floor cleaning operation, and vice versa, depending upon the rotational position of the upright handle 16 and vacuum motor housing 70 relative to the base pan 26.

Figure 6:
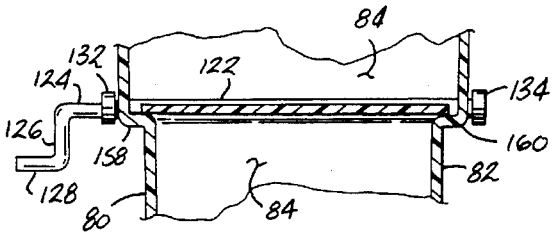

The performance of a vacuum cleaner is often measured by the amount of lift or suction generated by the vacuum motor which is realized at the suction opening such as the flexible hose 20 or brush roll chamber 66. Therefore, it is important to minimize the suction losses along the air flow path such that substantially all of the suction generated by the vacuum motor is realized at the appropriate air and dirt inlet. The conversion valve assembly 120 according to the invention is adapted to provide an improved seal between the impeller fan chamber and the non-operative suction opening thereby improving performance at the operative suction opening. In order to improve the seal, the side walls 80, 82 of the working air conduit 76 are provided with shoulder flanges 158, 160, respectively, as shown in FIG. 6. Similarly, the bottom wall 78 has a shoulder flange 162 (FIG. 4) formed therein. When the flapper valve member 122 is pivoted to the first position as shown in FIG. 3, the flapper valve member 122 abuts the shoulder flanges 158, 160, 162 around the bottom and side edges of the flapper valve member 122. The abutting contact between the flapper valve member 122 and the shoulder flanges 158, 160, 162 creates an efficient air flow seal, thereby maximizing the suction or lift which is applied to the flexible hose 20.

The shoulder construction of the working air conduit 76 also provides certain manufacturing advantages. First, the simple abutting contact of the flapper valve member with the shoulder flanges dramatically reduces the manufacturing tolerances required in forming the side walls 80, 82 and the flapper valve member 122. The width of the flapper valve need not be precisely matched to the spacing between the opposed side walls in order to create an efficient seal. Utilizing the shoulder structure with the abutting flapper valve, there is no need to manufacture these members with precise tolerances, thereby minimizing manufacturing costs. In addition, the shoulder construction also allows limited lateral movement of the flapper valve member 122 between the side walls 80, 82 without resulting in any decrease in the sealing efficiency of the flapper valve member 122.

The flapper valve member 122 is also adapted to create an improved seal between the source of suction and the flexible hose 20 in the second position as seen in FIG. 4. In this position, the flapper valve member 122 is pivoted upwardly such that the face of the flapper valve 122 abuts the bottom surface of the top plate 84. Again, this abutting structure creates an improved, more effective seal and eliminates the need for precise manufacturing tolerances.

As is evident, the convertible upright vacuum cleaner 12 having a conversion valve assembly according to the invention realizes several significant advantages. First, the conversion valve assembly automatically converts the vacuum cleaner between above-the-floor cleaning and on-the-floor cleaning, and vice versa, depending upon the rotational position of the handle and vacuum motor housing relative to the base pan. In addition, the conversion valve assembly according to the invention, creates an improved and effective seal in the working air flow channel between the non-operative suction opening. This improved seal is realized in conjunction with a reduction in manufacturing costs.

Reasonable variation and modification are possible within the spirit of the foregoing specification and drawings without departing from the scope of the invention.

The embodiments for which an exclusive property or privilege is claimed are defined as follows:

1. A convertible vacuum cleaner comprising:

a foot comprising:

a working air flowpath;

a first suction opening in fluid communication with the working air flowpath; and a second suction opening in fluid communication with the working air flowpath;

a source of suction in fluid communication with the working air flowpath;

a handle pivotally mounted to the foot for movement between a substantially upright position and a tilted position;

a contoured cam provided on the handle, the cam having a first contoured portion and a second contoured portion; and a conversion valve member pivotally provided on the foot intermediate the source of suction and the first and second suction openings for selectively blocking fluid communication between the first and second suction openings and the source of suction, the conversion valve member comprising:

a rotation shaft mounted to the foot for rotation about an axis of rotation;

a flapper valve element nonrotatably mounted to the rotation shaft, positioned in the working air flowpath and pivotal about the rotation shaft axis of rotation between a first position in which the flapper valve element blocks fluid communication between the source of suction and the first suction outlet and a second position in which the flapper valve element blocks fluid communication between the source of suction and the second suction outlet; and a cam follower coupled to the rotation shaft and positioned to abut the contoured cam, the cam follower being adapted follow the cam as the handle rotates relative to the foot, the cam being shaped so that the flapper valve element is in the first position when the handle is in the substantially upright position and is in the second position when the handle is in the tilted position.

2. A convertible vacuum cleaner according to claim 1 wherein the contoured cam comprises a groove having first and second contoured portions wherein the cam follower is slidably received in the groove.

3. A convertible vacuum cleaner according to claim 2 wherein the handle further comprises a housing supporting the source of suction.

4. A convertible vacuum cleaner according to claim 3 wherein the groove is provided on the housing such that the handle rotates relative to the base as the flapper valve element is actuated between the first and second positions.

5. A convertible vacuum cleaner according to claim 3 wherein the cam follower comprises a pin slidably received in the groove.

6. A convertible vacuum cleaner according to claim 1 wherein the first contoured portion is substantially linear and the second contoured portion is arcuate.

7. A convertible vacuum cleaner according to claim 1 wherein the conversion valve member further comprises a crank arm connected at one end to the rotation shaft and to the cam follower on the other end.

8. A convertible vacuum cleaner according to claim 7 wherein the conversion valve member is molded such that the rotation shaft, flapper valve, crank arm and pin are integrally molded to one another.

9. A convertible vacuum cleaner according to claim 1 wherein at least a portion of the fluid air conduit is defined by a plate member and a pair of sidewalls integrally formed on the foot, the plate member being selectively mounted to the sidewalls.

10. A convertible vacuum cleaner according to claim 9 wherein the conversion valve member further comprises at least one radially outward extending flange formed on the rotation shaft, the radial flange being adapted to be positioned closely adjacent to at least one of said sidewalls and the top plate when the conversion valve member is in the operative position in the working air conduit, the radial flange being adapted to limit the lateral movement of the conversion valve member relative to the working air conduit.

11. A convertible vacuum cleaner according to claim 9 wherein the first suction opening is provided on the plate member.

12. A convertible vacuum cleaner according to claim 11 wherein the first suction opening is connected to a flexible hose adapted for above-the-floor cleaning operations.

13. A convertible vacuum cleaner according to claim 12 wherein the flexible hose is extendible between a retracted position and an extended position.

14. A convertible vacuum cleaner according to claim 13 and further comprising a collar with an open outer end on a distal end of the flexible hose and a retainer at an upper portion of the handle to receive and retain the collar when the hose is in the retracted position, the retainer comprising an enclosed housing having an open bottom portion, the collar open outer end being unobstructed when the collar is received in the enclosed housing.

15. A convertible vacuum cleaner according to claim 1 wherein the first suction opening is connected to a flexible hose adapted for above-the-floor cleaning and the second suction opening comprises a chamber provided on the foot for on-the-floor cleaning operations, the chamber having an opening directed downwardly toward a surface to be cleaned.

16. A convertible vacuum cleaner according to claim 1 wherein the working air flow path comprises a bottom wall, a pair of side walls and a shoulder formed in the bottom and side walls, the flapper valve element being adapted to abut the shoulder in the first position thereby creating an effective seal between the source of suction and the second suction opening.

17. A convertible vacuum cleaner comprising:

a source of suction;

a foot having a first suction opening in fluid communication with the source of suction;

a handle having an upper end and a lower end, the lower end being pivotally supported on the foot;

a flexible hose adapted for above-the-floor cleaning, the hose being in fluid communication with the source of suction and having a collar provided on an upper end thereof, the collar having an open outer end;

a conversion valve for selectively controlling the airflow between the source of suction and the first suction opening and the flexible hose;

a housing provided adjacent the upper end of the handle, the housing having a top wall, at least one side wall and an open bottom;

a retainer provided on one of the handle and housing for selectively retaining the collar of the hose to said one of the handle and housing, the retainer and collar being provided so that, when the collar is properly received in the retainer, the open outer end of the collar is spaced from the walls of the housing and remains unobstructed for the free flow of air therethrough.

18. A convertible vacuum cleaner according to claim 17 wherein the hose is extendible between a retracted position and an extended position.

19. A convertible vacuum cleaner according to claim 18 wherein the hose is in the retracted position when the collar is properly received in the retainer.

20. A convertible upright vacuum cleaner comprising:

a foot having:

a working air flowpath;

an accessory hose adapted for above-the-floor cleaning operations, the accessory hose being in fluid communication with the working air flowpath;

a brush roll chamber having a brush roll rotatably mounted therein and a suction opening provided therein which opens in a direction toward the surface to be cleaned;

a motor housing pivotally mounted to the foot;

a vacuum motor provided inside the motor housing and in fluid communication with the working air flowpath, the vacuum motor having a sidewall and being adapted to generate suction;

a handle having an upper end and a base end, the base end being mounted to the motor housing;

a groove formed in a sidewall of the motor housing, a portion of the groove being substantially linear and a portion of the groove being substantially arcuate wherein the centerpoint of the arc is the axis of rotation of the motor housing relative to the foot; and a conversion valve member pivotally provided on the foot intermediate the vacuum motor and the accessory hose and brush roll chamber for selectively blocking fluid communication between the vacuum motor and the flexible hose and brush roll chamber, the conversion valve member comprising:

a rotation shaft having an axis of rotation;

a flapper valve element depending from the shaft and being pivotally received in the working air flowpath in first and second positions, wherein the flapper valve element blocks fluid communication between the vacuum motor and the accessory hose in the first position and blocks fluid communication between the vacuum motor and the brush roll chamber in the second position;

a crank arm having one end provided on the rotation shaft, the crank arm extending radially outward from the rotation shaft; and a pin provided on the other end of the crank arm wherein the pin is slidably received in the groove so that the flapper valve element is biased into the first position when the pin is received in the linear portion of the groove and the flapper valve element is biased into the second position when the pin is received in the arcuate portion of the groove, the flapper valve element being biased between the first and second positions by the pivotal movement of the handle and motor housing relative to the conversion valve member and foot.

* * * * *